US006000103A

United States Patent [19]

Paice et al.

[11] Patent Number: 6,000,103

[45] Date of Patent: Dec. 14, 1999

[54] PORTABLE PENCIL POCKET

[76] Inventors: Bette Paice, 8 Stevenson Dr., R.R. 1, Box 114A, Red Creek, N.Y. 13143; Kristy M. Goodman, 4854 Whiskey Hill Rd.; Tiera Boyd, 6359 Eddie Rd., both of Wolcott, N.Y. 14590; Brandon Smith, 10406 Maple Ave., North Rose, N.Y. 14516; Jillian Kay Sherwin, 12113 Wheeler Rd., Wolcott, N.Y. 14590; Rosanne May Milem, P.O. Box 356, North Rose, N.Y. 14516; David K. Van Fleet, Jr., 11125 Wilson Rd.; Daniel Timothy Nau, 4477 Spring Lake Rd., both of Wolcott, N.Y. 14590; Justin James Bousquin, P.O. Box 42, North Rose, N.Y. 14516; Ronald Eugene Parisi, P.O. Box 206, N. Rose, N.Y. 14590; Miranda L. Ludwig, 11203 Wilson Rd., Wolcott, N.Y. 14590; Rebecca L. Goodman, 13604 B. Conquest Rd., Savannah, N.Y. 13146; Jared S. Putman, 3831 Wayne Ct. Rd., Lyons, N.Y. 14489; Evan James Parkison, 7455 Dutch St., Wolcott, N.Y. 14590; Christine Lucas, 5978 Draper St., Wolcott, N.Y. 14590; Chris La Patra, 7114 Wadsworth St., Wolcott, N.Y. 14590; Jason Walter Burgess, 6467 E. Port Bay Rd., Wolcott, N.Y. 14590; Thomas Humbert, 3898 Rose Valley Rd., Clyde, N.Y. 14433; Jeff Wren, 5374 Limkiln Rd.; Shane T. S. Frey, 4408 Butler Center Rd., both of Wolcott, N.Y. 14590; Shawna Lewis, 4271 Covell Rd., Clyde, N.Y. 14433; Benjamin Immerman, 5053 Whiskey Hill Rd., Wolcott, N.Y. 14590; Danielle French, 5862 Newhartford St., P.O. Box 141, Wolcott, N.Y. 14590; Laura Castor, 10275 Catchpole Rd., North Rose, N.Y. 14516; Andrew Coleman, P.O. Box 173, N. Rose, N.Y. 14516; Wendy Mottler, 5908 Williams St., Wolcott, N.Y. 14590; Will Lott, 8750 York Settlment, N. Rose, N.Y. 14516; Nicole Ferguson, 10586 Wane Center Rose Rd., Clyde, N.Y. 13344; Cindy Spencer, 5129 Brick Schoolhouse Rd., N. Rose, N.Y. 14516; Joshua Norton, Rte. 414, Clyde, N.Y. 13344; James Penta, 7465 Wadsworth Rd.; James McIntyre, 5574 Lasher Rd., both of Wolcott, N.Y. 14590; Wesley King, P.O. Box 31, North Rose, N.Y. 14516

[21] Appl. No.: 09/074,979

[22] Filed: May 8, 1998

[51] Int. Cl.[6] ..... A45C 11/04; B43K 25/00

[52] U.S. Cl. ..... 24/10 R; 224/269; 234/3.12; 206/38

[58] Field of Search ..... 24/10 R, 12, 3.7, 24/3.6, 3.13, 3.12, 11 CT; 2/249–251, 253; 224/269; 206/37, 38, 332; 211/69.1

[56] References Cited

U.S. PATENT DOCUMENTS

| | | | |
|---|---|---|---|
| 1,088,406 | 2/1914 | Davis | 224/250 X |
| 1,135,174 | 4/1915 | Gibbs | 2/250 X |
| 1,162,948 | 12/1915 | Sanders | 24/10 R |
| 1,252,268 | 1/1918 | Jennings | 224/249 X |
| 1,780,204 | 11/1930 | Mastin | 2/253 |
| 2,366,457 | 1/1945 | Pinkham | 24/10 R X |
| 2,415,208 | 2/1947 | Greenberg | 24/10 R X |
| 3,647,056 | 3/1972 | Jacobson et al. | 206/38 X |
| 3,830,415 | 8/1974 | Jacobson et al. | 224/230 |
| 4,334,326 | 6/1982 | Malow | 2/249 |
| 4,361,934 | 12/1982 | Darnell | 24/3.12 |
| 4,705,086 | 11/1987 | O'Neill | 224/269 X |
| 5,533,656 | 7/1996 | Bonaldi | 224/269 X |
| 5,785,221 | 7/1998 | Bishop | 224/269 |

*Primary Examiner*—James R. Brittain
*Assistant Examiner*—Robert J. Sandy

[57] ABSTRACT

A portable pencil pocket 10 has one or more compartments for holding pencils 40,42. The pocket is made of plastic webbing that is folded at one end to form a pocket 20 and at the other end to form a loop 22. A shower clip 50 holds the pocket 10 to an article of clothing, such as a belt loop or button hole.

6 Claims, 1 Drawing Sheet

PORTABLE PENCIL POCKET

BACKGROUND OF THE INVENTION

Students need a simple device for holding pens, pencils and other writing instruments. There are a number of solutions for this problem. Some students used a pencil case for holding pens, pencils and other material. The pencil case is a pocket with a zipper across the top. The pocket is long enough to hold pens, pencils, protractors, erasers and other materials. The zipper closes the pocket to retain the pencils. One problem with the pencil case is that a student may lose it.

Another solution to the problem is to simply put the pencils in a clothing pocket. That solution has certain drawbacks. Not all clothing has pockets and pockets in clothes for younger children are be too small to hold a full-size pencil.

SUMMARY OF THE INVENTION

We invented a portable pencil pocket that solves the above problems. The pocket holds two or more pencils. The pocket clips or otherwise fastens to an article of clothing or a clipboard or a loose-leaf book.

The portable pencil pocket is made of webbing material, preferably plastic. The pencil pocket has an elongated body. At one end of the body is a pocket. The pocket is a first overlapped portion of the webbing material that has its edges fixed together along its edges. The other end of the body has the second overlapped portion that is fixed across its width to form a loop. Stitching the edges of the overlapped portions forms the pocket and stitching the other end across its width forms the loop. In addition to stitching, the pocket can be made using glue, adhesive or by searing or otherwise heat-scaling and heat-attaching the plastic to itself. A clip through the loop at the end of the pocket holds the pocket in place. A typical, common household hook, such as a shower curtain hook is suitable. A keychain or other lanyard may be attached to the hook at one end. At the other end of the lanyard, there is a swivel clasp. The swivel clasp has a movable spring-biased opening that is normally biased to a closed position. The clasp opens by pressing on a lug. The open clasp fits over an article of clothing such as a belt loop or a button-hole. Releasing the lug closes the clasp.

The invention includes a method of making a portable pocket for writing instruments. The method has steps for cutting a length of webbing, preferably plastic webbing, to a first length to form an elongated body of material. One end of the material is folded over itself in a direction towards the other end in order. The folded material overlaps the body. The edges of the overlapped portion are fixed to one another to form the pocket. A portion of the middle of the pocket may also be fixed to the body in a direction parallel to the edges. That divides the pocket into two portions, each portion capable of holding at least one writing instrument. The second end of the material folds over the body in a direction toward the pocket. The second end of the material is fixed to the body across the width of the material in order to form a loop of body material at the other end.

In the preferred embodiment, the body of material is about 14 inches long, the length of the pocket is about 4 ½ inches, and the length of the loop is about 1 inch.

The edges of the pocket and the loop are stitched, glued, seared, or otherwise thermal-sealed together.

DRAWINGS

DETAILED DESCRIPTION

Figure 1:
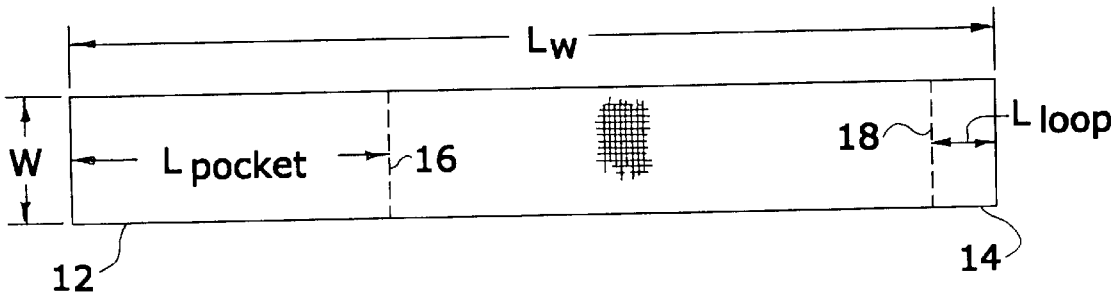
FIG. 1 is a plan view of a length of material for forming a portable pencil pocket.
Figure 2:
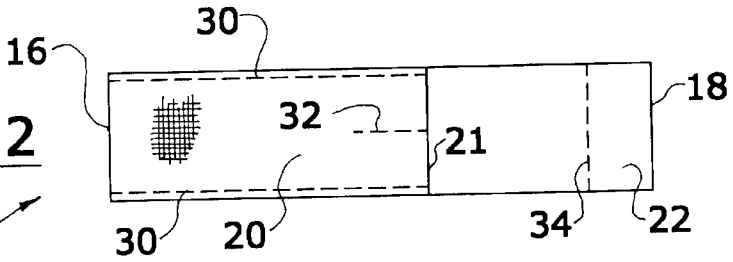
FIG. 2 is a plan view of the pencil pocket with the loop and pocket formed therein.
Figure 3:
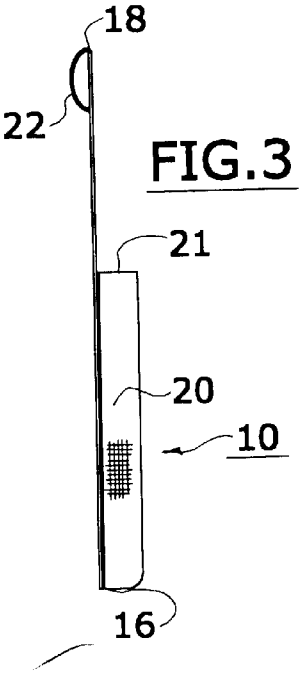
FIG. 3 is a side view of the pencil pocket of FIG. 2 taken along the line 2—2.

FIG. 1 shows a length of webbing material having a length $L_w$ and a width W. The webbing material 12 is shown with a pocket bottom line 16 and a loop top line 18. The portion of the material labeled $L_{pocket}$ is approximately 4 ½ inches long. The material has a length $L_w$ of approximately 14 inches. The material has a W of approximately 2 inches. Dashed line 18 indicates the fold line of the loop. The loop has a length of approximately 1 inch, $L_{loop}$. The length of material designated $L_{pocket}$ is folded along pocket fold line 16 to form the pocket 20. Pocket 20 has its edges of the webbing 12 aligned. Turning to FIGS. 2 and 3, the aligned edges are stitched 30 to form the pocket 20 with opening 21. Further stitching 32 is provided in the middle of the pocket near the opening 21. The stitching 32 serves to divide the pocket 20 into two compartments each capable of holding one or more writing instruments. The loop end of 14 of the pencil pocket 10 is folded on line 18 to form the loop 22. The loop end 14 is secured to the pencil pocket 10 by stitching 34.

Figure 4:
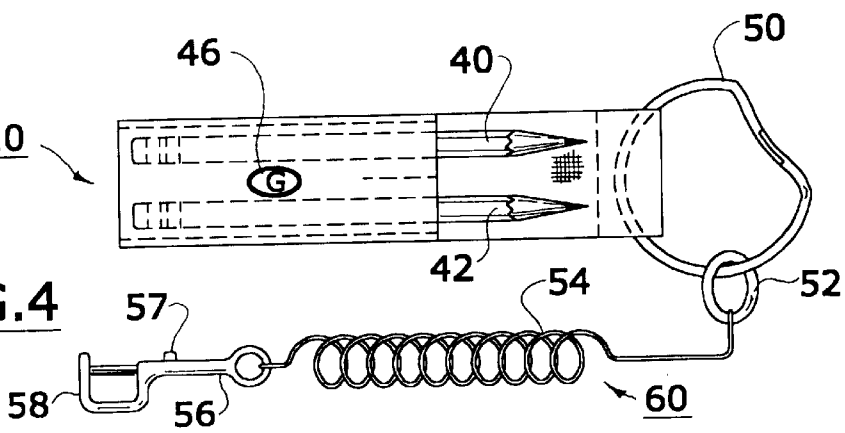
FIG. 4 is a further plan view of the pencil pocket, including a clip and a lanyard with a clasp.

As shown in FIG. 4, pencils 40, 42 are inserted into the compartments of the pocket 20. A shower curtain clip 50 or other suitable clip is passed through the loop and secured closed. A ring 52 is held by the clip 50 and is also attached to one end of a lanyard 54. The other end of the lanyard 56 is connected to a spring biased clasp 56. The clasp has a movable lug portion 57 that opens the catch 58 of the clasp in order to fix the clasp to a belt loop or a button-hole or a clipboard.

The invention was tested using a variety of different materials. As a result of those tests, it was concluded that webbing, especially plastic webbing, was the most durable and the easiest to assemble because it required no hemming. A number of colors were tested as well. The most desirable color was black since it stayed looking newest the longest. A number of different sized pocket folds were tested and it was concluded that a 4 ½ inch fold was preferred for holding pencils. A number of widths were also tested with the result that a 2 inch width was the most practical and held between two and three pens or pencils depending upon the width of each. Stitching 32 at the top end provides additional friction to prevent pencils from falling out of the pocket 20. There are many ways to attach the pencil pocket 10 to clothing including a string or shoelace that can be inserted through the loop 22 and worn around the neck. However, the preferred embodiment is a swivel clasp 56 fixed with lanyard 54 to the curtain clip 50. The invention also provides for a logo 46. The logo might include the student's initials. This is helpful to distinguish one pencil pocket from another. The logo may be embroidered or sketched on the outside of the pocket 20.

Pencil pockets 10 are made by cutting the webbing into 14-inch strips. The ends of the webbing are seared in order to prevent them from unraveling. Next, the logo 46 is applied to the outside of the pocket. The loop end 14 is folded on loop fold line 18 and that end of the webbing is sewn to the body 10 in order to form a loop. Then, the end 12 is folded on the pocket line 16 and the edges of the folded pocket are aligned to the body edges. The edges are then stitched 30 together to form the pocket 20 with an opening 21 at the end facing the loop. The center of the pocket is stitched at least partially down from the opening 21 by using stitches 32. This forms two compartments for two or more pens or pencils. The shower curtain clip 50 is attached to the loop 22. A coil keychain comprising ring 52, lanyard 54 and clasp 56 are attached to the clip 50.

Having thus disclosed the preferred embodiment of our invention, those skilled in the art will understand that further modifications, additions, deletions and other changes may be made to the preferred embodiment without departing from the spirit and scope of the invention as set forth in the following claims.

What is claimed:

1. A method of making a portable pocket for holding writing instruments comprising the steps of:

cutting a length of plastic webbing material to a first length to form an elongated body of material;

folding the first end of the material over the body in a direction toward the second end of the body to overlap the body;

fixing opposite edges of the overlapped portion of the body to each other to form a pocket at one end of the body;

fixing together a portion of the middle of the pocket between the opposite edges and in a direction parallel to the edges to divide the pocket into two portions, each portion for holding at least one writing instruments;

folding the second end of the material over the body in a direction toward the first end of the body to overlap the body to form a loop; and fixing the second end of the material to the body across the width of the material to form a loop at the other end of the body.

2. The method of claim 1 wherein the first length of material is about fourteen inches, the length of the pocket is about four and one-half inches and the length of the loop is about one inch.

3. The method of claim 1 wherein the material is fixed together by one selected from the group consisting of stitching, gluing and searing.

4. A method of making a portable pocket for holding writing instruments comprising the steps of:

cutting a length of plastic webbing material to form an elongated body of material about two inches wide and about fourteen inches long;

folding the first end of the material over the body in a direction toward the second end of the body to overlap the body by about four and one-half inches;

stitching opposite edges of the overlapped four and one halfinch portion of the body to form a pocket at one end of the body;

making a stitch in the middle of the pocket between opposite edges and in a direction parallel to the edges to divide the pocket into two portions, each portion for holding at least one writing instrument;

folding the second end of the material over the body in a direction toward the first end of the body to overlap the body by about one inch to form a loop; and stitching across the width of the overlapped one inch portion to form a loop at the other end of the body.

5. The method of claim 4 comprising the further step of attaching a hook to the loop.

6. The method of claim 5 comprising the further step of attaching a keychain to the hook.

* * * * *